US006904889B2

(12) United States Patent
Matsuda et al.

(10) Patent No.: US 6,904,889 B2
(45) Date of Patent: Jun. 14, 2005

(54) ENGINE FOR PERSONAL WATERCRAFT AND CRANKSHAFT THEREOF

(75) Inventors: Yoshimoto Matsuda, Kobe (JP); Yoshinobu Tanaka, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/349,747

(22) Filed: Jan. 21, 2003

(65) Prior Publication Data

US 2003/0140889 A1 Jul. 31, 2003

(30) Foreign Application Priority Data

Jan. 25, 2002 (JP) ..... 2002-016713

(51) Int. Cl.[7] ..... F02B 77/04
(52) U.S. Cl. ..... 123/198 A; 123/195 A; 123/90.31
(58) Field of Search ..... 123/195 A, 90.31

(56) References Cited

U.S. PATENT DOCUMENTS 5,495,833 A * 3/1996 Ishizaka et al. ..... 123/179.25
6,205,987 B1 * 3/2001 Shigedomi et al. ..... 123/583
6,626,140 B2 * 9/2003 Aichinger et al. ..... 123/195 A

FOREIGN PATENT DOCUMENTS

JP 2000130176 A * 5/2000 ..... F02B/39/00

* cited by examiner

*Primary Examiner*—Thomas Denion
*Assistant Examiner*—Zelalem Eshete
(74) *Attorney, Agent, or Firm*—Alleman Hall McCoy Russell & Tuttle LLP

(57) ABSTRACT

Disclosed is an engine of a personal watercraft having a water jet pump at a rear end thereof, in which a center of gravity of the engine is located rearward for improvement of planing capability of the watercraft. The engine comprises: a crankcase having a front end wall and a rear end wall; a crankshaft provided inside the crankcase; a generator provided at an output end portion of the crankshaft, the generator including a rotor fixed to the crankshaft; a starter motor provided on an output end side of the crankshaft outside the crankcase; and a clutch provided between the starter motor and the rotor of the generator, for connecting/disconnecting the starter motor to/from the rotor.

10 Claims, 6 Drawing Sheets

ENGINE FOR PERSONAL WATERCRAFT AND CRANKSHAFT THEREOF

BACKGROUND OF THE INVENTION

Field of the Invention

The present invention relates to an engine for a personal watercraft and a crankshaft thereof. More particularly, the present invention relates to an engine mounted in a body for driving a propulsion device of a personal watercraft that ejects water rearward and planes on a water surface as the resulting action, and a crankshaft suitable for the engine.

In recent years, so-called jet-propulsion personal watercraft (PWC) have been widely used in leisure, sport, rescue activities, and the like. FIG. 5 shows an example of such personal watercraft.

In a personal watercraft 81 in FIG. 5, A denotes a body of the watercraft. The body A comprises a hull H and a deck D covering the hull H from above. A line at which the hull H and the deck D are connected over the entire perimeter thereof is called a gunnel line G. L denotes a waterline in a state of the watercraft.

A straddle-type seat S is mounted onto an upper surface of the body A so as to extend substantially from a center portion to a rear portion over the deck D along the longitudinal direction of the watercraft 81. Straddling the straddle-type seat S, the rider grips a steering handle B located forward of the seat S and steers the watercraft. Hereinafter, "forward" refers to the direction toward which the watercraft moves and "rearward" refers to the opposite side.

The personal watercraft 81 is configured to have a water jet pump 83 that pressurizes and accelerates water sucked from a water intake 82 generally provided on a hull bottom surface of the body A and ejects the water rearward through a steering nozzle 84. Thereby, the body A is propelled. An engine 85 for driving the water jet pump 83 is contained in an engine room R located below the seat S. A propeller shaft 86 is connected to an output shaft of the engine 85 and an impeller 87 of the water jet pump 83 is attached on the propeller shaft 86.

Commonly, a two-cycle engine is mounted in the personal watercraft as the engine 85. Recently, in addition to this, the use of a four-cycle engine has been proposed.

FIG. 6 shows an example of the four-cycle engine. The engine 85 is a four-cylinder engine and is placed such that cylinders are arranged along the longitudinal direction of the body A (FIG. 5). Reference numeral 88 denotes a cylinder, 89 denotes a piston, 90 denotes a crankshaft, 91 denotes a crankcase, 92*a* denotes a cylinder head, and 92*b* denotes a head cover. A cam chain tunnel 93 is formed in a rear end portion of the engine 85, and a generator 94 and a starter motor 95 are mounted in a front end portion of the engine.

A rear end portion of the crankshaft 90 of the engine 85 penetrates through a rear end wall 91*a* of the crankcase 91 and penetrates through the cam chain tunnel 93 so as to protrude outwardly in the rear end of the engine 85. A coupling 86*a* for connecting the propeller shaft 86 (FIG. 5) is mounted to the rear end of the crankshaft 90. A sprocket 93*b* for a cam chain 93*a* is mounted to a position of the crankshaft 90 inside the cam chain tunnel 93. Meanwhile, a front end portion of the crankshaft 90 penetrates through a front end wall 91*b* of the crankcase 91 and protrudes into a housing 94*a* covering the generator 94. A rotor 94*b* of the generator 94 is mounted to the front end portion of the crankshaft 90. A stator 94*c* of the generator 94 is fixed to the housing 94*a*.

Since the above-structured engine has weight more than that of the two-cycle engine, it is desirable to position the engine in the personal watercraft so as to minimize the effect of the engine having more weight on cruising attitude of the watercraft. However, since placement of the engine is restricted by the space of the engine room of the personal watercraft, it is difficult to greatly change the position of the engine. For the purpose of improvement of the cruising attitude of the personal watercraft, it is desirable to locate a center of gravity of the four-cycle engine closest to the rear of the personal watercraft.

In order to obtain a power as high as that of the two-cycle engine in the four-cycle engine without an increase in displacement of the engine, increases in an engine speed and the number of cylinders are effective.

However, with the increase in the number of the cylinders, it becomes necessary to increase the length of the crankshaft 90. It would be difficult to manufacture a longer crankshaft in the conventional manufacturing apparatus, and therefore, there arises a need for a manufacturing apparatus capable of manufacturing the longer crankshaft. But, the manufacturing apparatus of the crankshaft having a complex shape and requiring high accuracy would be complex and expensive.

SUMMARY OF THE INVENTION

The present invention addresses the above-described conditions, and an object of the present invention is to provide an engine having a center of gravity located rearward to be suitable for a personal watercraft, and a crankshaft suitable for the engine.

According to the present invention, there is provided an engine of a personal watercraft having a water jet pump at a rear end thereof, comprising: a crankcase having a front end wall and a rear end wall; a crankshaft provided inside the crankcase; a generator provided at an output end portion of the crankshaft, the generator including a rotor fixed to the crankshaft; a starter motor provided on an output end side of the crankshaft outside the crankcase; and a clutch provided between the starter motor and the rotor of the generator, for connecting/disconnecting the starter motor to/from the rotor.

With such a structure, since the generator, the starter motor, the clutch and the like of the engine, which have relatively large weight, are located on the output end side of the engine, a center of gravity of the engine is advantageously located rearward in the engine so as to be suitable for the watercraft. Since the generator and the starter motor are placed on the output end side of the engine, the clutch is correspondingly placed on the output end side of the engine. As defined herein, the output end side refers to the rear side of the engine.

Preferably, the engine may further comprise: a cam chain tunnel formed in a front portion of the front end wall of the crankcase on an opposite side of the output end side of the crankshaft; and a sprocket for driving a cam mechanism of the engine, the sprocket being mounted to an end portion of the crankshaft passing through a penetrating hole formed in the front end wall of the crankcase and protruding into the cam chain tunnel.

With such a structure, the diameter of the sprocket can be selected irrespective of the diameter of output end side of the crankshaft adapted to transmit an output of the crankshaft to the propeller shaft. This reduces the diameter of the sprocket. As a result, a lightweight and compact engine is achieved. Therefore, for the watercraft, it is preferable to place the cam chain on the opposite side (front end side of the engine) of the output side of the crankshaft.

Preferably, the engine may further comprise: a generator chamber formed in a rear portion of the rear end wall of the crankcase, for containing the generator, the output end portion of the crankshaft may pass through a penetrating hole formed in the rear end wall of the crankcase and protrudes into the generator chamber, and a seal member may be provided in the penetrating hole of the crankcase to seal between an inside of the crankcase and the generator chamber. In this structure, since an oil inside the crankcase is prevented from flowing into an inside of the generator chamber, the loss of a rotational energy of the rotor of the generator which would be caused by viscosity of the oil is avoided.

Preferably, the engine may further comprise a water jacket formed in a housing constituting the generator chamber to allow cooling water to flow therethrough. With this structure, the generator and its vicinity are cooled more effectively.

The engine may comprise a generator chamber formed in a rear portion of the rear end wall of the crankcase, for containing the generator; a cam chain tunnel communicating with an inside of the generator chamber; and a sprocket for driving a cam mechanism, the sprocket being mounted to a portion of the crankshaft between the rotor and the penetrating hole in the generator chamber, and the rotor is mounted to the output end portion of the crankshaft passing through a penetrating hole formed in the rear end wall of the crankcase and protruding into the generator chamber. Such a structure is advantageous in that the generator and its vicinity are efficiently cooled by the oil dropping through the cam chain tunnel although a slight loss of the rotational energy of the rotor of the generator occurs due to the oil.

According to the present invention, there is provided a crankshaft of an engine for a personal watercraft, comprising: a crankshaft body; a first extended shaft member connected to one end portion of the crankshaft body so as to be rotatable integrally with and separable from the crankshaft body; and a rotor-mounting portion provided at an end portion of the crankshaft on the first extended shaft member side, for mounting a rotor of a generator of the engine, and the first extended shaft member constitutes an output end part of the engine.

With such a structure, the crankshaft body is shortened. Consequently, manufacturing the crankshaft becomes easy. In addition, the generator can be easily placed in the output end side of the crankshaft.

Preferably, the rotor-mounting portion may be formed integrally with the first extended shaft member. With this structure, the rotor of the generator is easily placed on the output end side of the crankshaft.

Preferably, the crankshaft body may comprise an extended shaft mounting portion for connecting the first extended shaft member and the rotor-mounting portion in this order as seen from the one end portion of the crankshaft body, and the first extended shaft member may be mounted to the extended shaft mounting portion to thereby allow the rotor of the generator to be fixed to the rotor-mounting portion. With this structure, the rotor of the generator is easily placed on the output end side of the crankshaft.

The crankshaft may further comprise a coupling for taking out an output of the engine, the coupling being provided at a rear end portion of the first extended shaft member. Thereby, the output of the engine can be easily taken out.

Preferably, the crankshaft may further comprise a second extended shaft member connected to the other end portion of the crankshaft body to be rotatable integrally with and separable from the crankshaft body; and a sprocket-mounting portion for mounting a cam-driving sprocket on the second extended shaft member. With this structure, the crankshaft body is shortened, and therefore manufacturing the crankshaft becomes easy. The crankshaft is applied to an engine having a cam chain tunnel at a front portion thereof.

The crankshaft may comprise: a sprocket-mounting portion formed at the one end portion of the crankshaft body adjacent the first extended shaft member, for mounting a cam-driving sprocket of the engine. Such a crankshaft is suitably used in the engine having the cam chain tunnel communicating with an inside of the generator.

Preferably, in the crankshaft, a connecting hole may be formed in an end portion of the first extended shaft member for connecting the crankshaft body by inserting the one end portion of the crankshaft body thereinto, an outer peripheral face of the one end portion of the crankshaft body and an inner peripheral face of the connecting hole of the first extended shaft member may respectively have a cylindrical fitting face for centering, and an engagement portion for preventing circumferential relative rotation between the crankshaft body and the first extended shaft member. A center axis of the fitting face of the crankshaft body corresponds with a rotational center axis of the crankshaft and a center axis of the fitting face of the first extended shaft member corresponds with a center axis of the first extended shaft member. With such a structure, the crankshaft body can be made shorter.

According to the present invention, there is provided an engine of a personal watercraft comprising: a crankcase having a front end wall and a rear end wall; a crankshaft provided inside the crankcase; a generator provided at an output end portion of the crankshaft, the generator including a rotor fixed to the crankshaft; a starter motor provided on an output end side of the crankshaft outside the crankcase; a clutch provided between the starter motor and the rotor of the generator, for connecting/disconnecting the starter motor to/from the rotor, the crankshaft includes: a crankshaft body; a first extended shaft member having a tip end portion and a base end portion and connected to an end portion of the crankshaft body so as to be rotatable integrally with and separable from the crankshaft body; and a rotor-mounting portion provided at an end portion of the crankshaft on the first extended shaft member side, for mounting the rotor of the generator, and the first extended shaft member constitutes an output end part of the engine. With this structure, the center of gravity of the engine is located rearward to be suitable for the personal watercraft, and manufacturing the engine becomes easy.

The above and further objects and features of the invention will be more fully apparent from the following detailed description with accompanying drawings.

DETAILED DESCRIPTION OF THE PREFERRED EMBODIMENTS

Hereinafter, embodiments of an engine of a personal watercraft of the present invention will be described with reference to the accompanying drawings.

Figure 1:
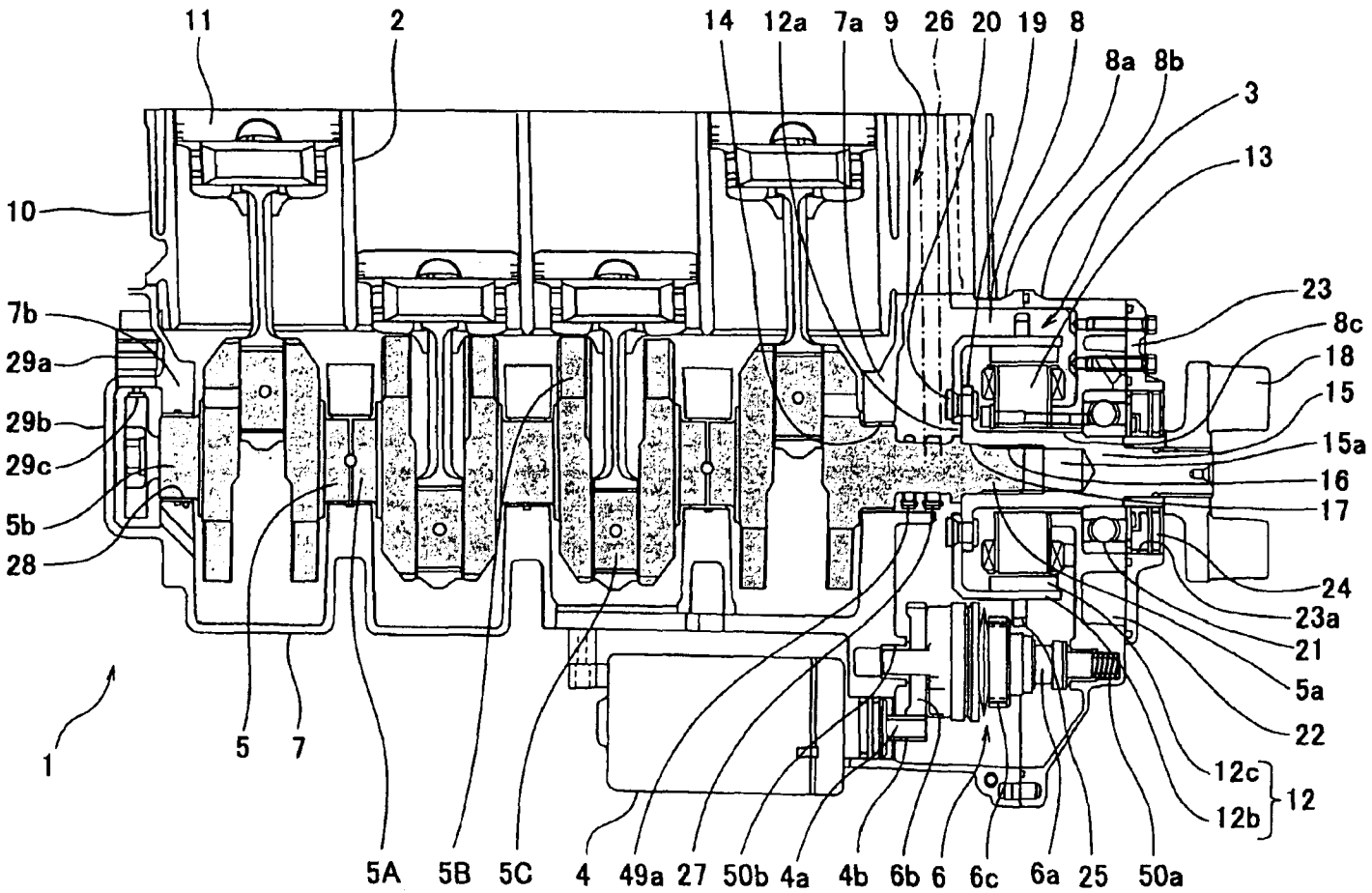
FIG. 1 is a longitudinal sectional view showing a portion including a crankshaft of an engine for a personal watercraft according to an embodiment of the present invention.

FIG. 1 is a longitudinal sectional view showing main components including a crankshaft of an engine of a personal watercraft according to an embodiment of the present invention.

Figure 6:
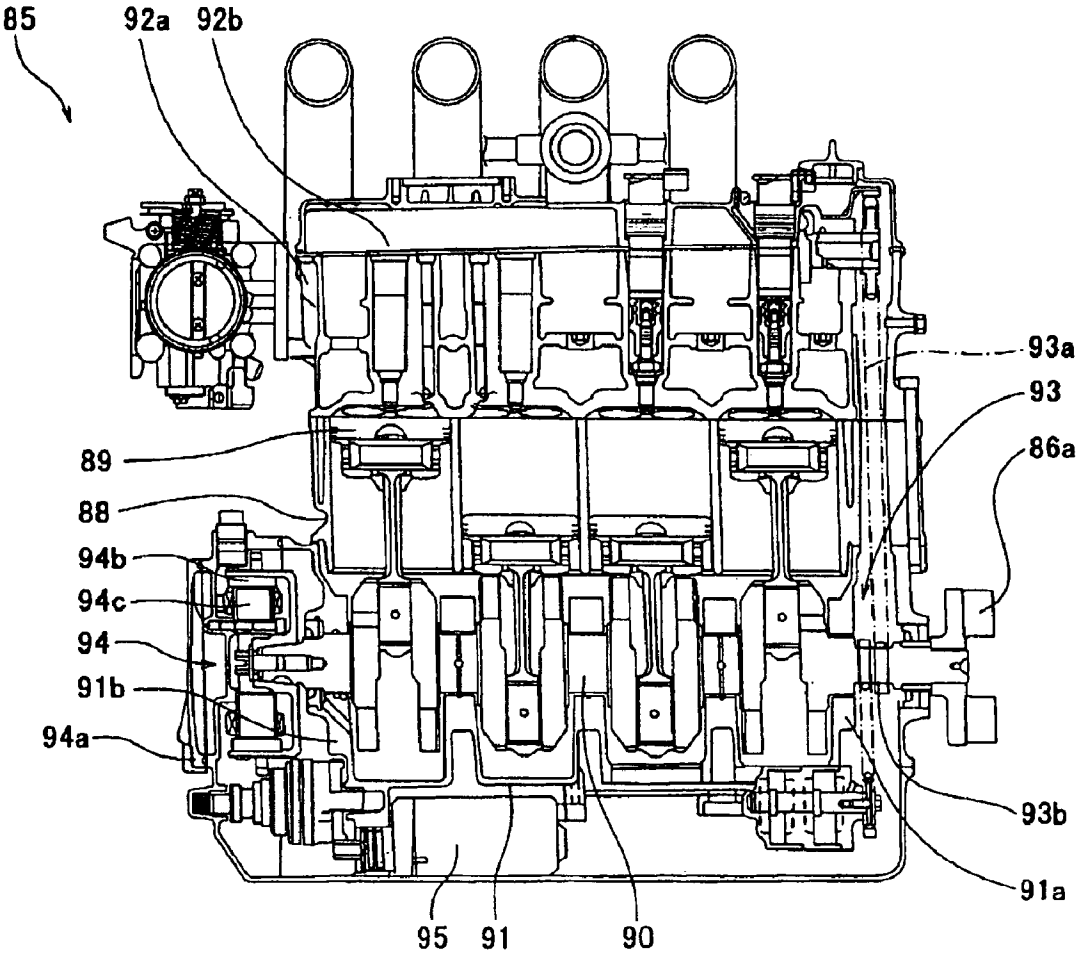
PRIOR ART Fig. 6
FIG. 6 is a longitudinal sectional view showing the conventional engine of the personal watercraft.

An engine 1 of this embodiment is a multi-cylinder (for example, four-cylinder) four-cycle engine. The engine 1 is mounted in the watercraft such that cylinders 2 are arranged along the longitudinal direction of a body of the watercraft (not shown) like the conventional engine 85 (see FIG. 6). Therefore, a crankshaft 5 of the engine 1 is placed along the longitudinal direction of the body and an output end portion thereof is connected to a propeller shaft of the watercraft (not shown). The propeller shaft functions to drive a water jet pump provided at a rear portion of the watercraft. The propeller shaft extends rearwardly from the output end portion of the crankshaft 5 and is connected to the water jet pump.

In the engine 1, a generator 3, a starter motor 4, and a clutch 6 for connecting/disconnecting the starter motor 4 to/from the crankshaft 5 are located in the vicinity of the rear end of the engine 1. Here, "front" refers to the direction toward which the body of the watercraft moves and "rear" refers to the opposite direction. More specifically, a coupling 18 for connecting the propeller shaft mentioned later is located on the "rear" side.

In FIG. 1, reference numeral 7 denotes a crankcase, 8 denotes a generator chamber that contains the generator 3, 9 denotes a cam chain tunnel, 10 denotes a cylinder block, and 11 denotes a piston. A cylinder head and a cylinder head cover provided over the cylinder block 10 are not illustrated in FIG. 1. The clutch 6 is accommodated in the generator chamber 8 together with a rotor 12 of the generator 3 and a stator 13 of the engine. The generator chamber 8 is comprised of a body portion 8*a* formed integrally with the crankcase 7 so as to open outside at a rear end thereof, and a first lid member 8*b* removably attached to the body portion 8*a* to close the open part of the body portion 8*a*.

A cam chain tunnel 9 that contains a cam chain 26 is provided in a rear portion of a rear end wall 7*a* of the crankcase 7. The cam chain tunnel 26 extends from the body portion 8*a* of the generator chamber 8 to the cylinder head (not shown) through an inside of the cylinder block 10. The cam chain 26 serves to transmit rotation of the crankshaft 5 to a camshaft provided on the cylinder head. The crankshaft 5 comprises a crankshaft body 5A (expressed as colored in FIG. 1) having a crank web 5B, a crank pin 5C and the like, and a first extended shaft member 15 as an output end part of the crankshaft 5.

A rear end portion 5*a* of the crankshaft body 5A passes through a penetrating hole 14 formed in a rear end wall 7*a* of the crankcase 7 so as to be rotatably supporting the crankshaft 5 and protrudes into an inside of the generator chamber 8. The rear end portion 5*a* has a screw portion 16. The screw portion 16 is screwed into an inner thread formed in a connecting hole 15*a* of the first extended shaft member 15 such that the first extended shaft member 15 can rotate integrally with the crankshaft body 5A. Alternatively, the first extended shaft member 15 may be connected to the crankshaft body 5A so as to be integrally rotatable by any suitable means, including by a spline connection. In this embodiment, in the portion where the rear end portion 5*a* is fitted to the first extended shaft member 15, the screw portion 16 is formed on a rear end side of the rear end portion 5*a* and a centering location portion 17 is formed adjacent a front end side of the screw portion 16 (on the opposite side of the rear end side). In the centering location portion 17, an outer peripheral face of the rear end portion 5*a* is fitted to a corresponding inner peripheral face of the connecting hole 15*a* of the first extended shaft member 15 without substantial clearance. The outer peripheral face of the rear end portion 5*a* and the corresponding inner peripheral face of the first extended shaft member 15 are respectively formed concentrically with a rotational center axis of the crankshaft 5.

The first extended shaft member 15 passes through a penetrating hole 8*c* formed in the first lid member 8*b* of the generator chamber 8 and protrudes outwardly. The coupling 18 for connecting the propeller shaft (not shown) is connected by a spline to a rear end portion (output end portion) of the outwardly protruding first extended shaft member 15. The portion where a spline groove is formed constitutes a coupling mounting portion. The rotor 12 of the generator 3 is mounted to an outer periphery of a portion of the first extended shaft member 15 which is located inside the generator chamber 8 so as to be integrally rotatable. More specifically, an outwardly extending flange 19 of a circular-ring shape is formed at an outer periphery of a front end of the first extended shaft member 15. The rotor 12 is of a cylinder shape having a bottom and is mounted to the flange 19 by means of a rivet 20. An opening 12*a* is formed in the bottom of the rotor 12 to allow the rear end portion 5*a* of the crankshaft body 5A to be inserted thereinto. A magnet 12*c* is fixed to the inner peripheral face of a cylindrical body portion 12*b* of the rotor 12.

A stator 13 of the generator 3 is removably mounted to the first lid member 8*b* of the generator chamber 8. The penetrating hole 8*c* formed in the first lid member 8*b* has an increased diameter in a rear portion thereof and a bearing 21 is mounted in the increased-diameter portion for rotatably supporting the first extended shaft member 15. A concave portion 22 is formed in an outer face of the first lid member 8*b* to allow cooling water to flow therethrough. A second lid member 23 is removably attached to close the concave portion 22. In this embodiment, the concave portion 22 is circularly formed in the first lid member 8*b* around the bearing 21, and constitutes a water jacket for introducing the cooling water. The water jacket serves to cool the generator 3, the bearing 21, an oil dropping from the cam chain tunnel 9, and the like. A seal member 24 is provided in a penetrating hole 23*a* of the second lid member 23, through which the first extended shaft member 15 penetrates.

The water jacket of this embodiment is formed in the rear end wall of the first lid member 8*b* to surround the bearing 21. Instead, the water jacket may be provided at an outer peripheral wall of the generator chamber 8 or the like, as necessary.

The clutch 6 is accommodated in the generator chamber 8 in such a manner that both ends of a shaft 6*a* of the clutch 6 are supported by support holes 50*a*, 50*b* formed in the crankcase 7 and the first lid member 8*b*, respectively. An output shaft 4*a* of the starter motor 4 mounted to an outer face of the side wall at the rear portion of the crankcase 7 protrudes into the generator chamber 8. A gear 4*b* provided on the output shaft 4*a* is in mesh with a first gear 6*b* provided on the shaft 6*a* of the clutch 6. A second gear 6*c* is provided on the shaft 6*a* of the clutch 6 so as to be axially movable. A gear 25 with/from which the second gear 6*c* engages/disengages is provided on the outer peripheral face of the rotor 12 (on the cylindrical portion 12*b* of the rotor 12). When the rotation of the starter motor 4 is transmitted to the clutch 6 and causes the shaft 6*a* of the clutch 6 to rotate, the second gear 6*c* moves to engage with the gear 25 of the rotor 12. The rotational force transmitted in this manner is transmitted to the crankshaft 5 through the rotor 12.

It should be appreciated that gears in the starting mechanism provided between the starter motor and the crankshaft may be always in mesh with each other, and a one-way clutch is adapted to connect/disconnect transmission between the starter motor and the crankshaft. Alternatively, a stator motor containing a built-in clutch may be used. In brief, the clutch needs to be adapted to connect/disconnect transmission of the power between the stator motor and the crankshaft. In this embodiment, the gear 25 as an output end gear in a reduction gear train of the starting mechanism is provided on the outer periphery of the rotor 12. But, the starting mechanism is not intended to be limited to the above, so long as the mechanism is adapted to rotate the crankshaft during the starting of the engine. For example, the starter motor may be installed at the rear portion of the engine in such a manner that the output end gear in the reduction gear train is attached to the bottom portion of the rotor 12, the outer periphery of a member adapted to rotate in mesh with the crankshaft, or the crankshaft.

A sprocket 27 around which the cam chain 26 is installed is formed in the rear end portion 5*a* of the crankshaft body 5A protruding into the generator chamber 8 in a portion between the first extended shaft member 15 and the rear end wall 7*a* having the penetrating hole 14 of the crankcase 7 such that the sprocket 27 is integral with the crankshaft 5.

A front end portion 5*b* of the crankshaft body 5A is rotatably supported by a penetrating hole 28 formed in the front end wall 7*b* of the crankcase 7 and protrudes through the penetrating hole 28. The protruding portion of the front end portion 5*b* is covered by a sensor case 29*b* formed in the outer face of the front end wall 7*b* of the crankcase 7. A rotation sensor 29*a* is attached to a sensor case 29*b*, for detecting a member 29*c* mounted to the front end portion 5*b*. According to the detection by the rotation sensor 29*a*, ignition timing or the like of the engine is controlled.

According to the above-mentioned structure, the generator 3 is placed at a position corresponding to the rear end portion 5*a* of the crankshaft 5 of the engine 1, the starter motor 4 is placed on the outer face of the rear portion of the side wall of the crankcase 7, and the clutch 6 for connecting/disconnecting the starter motor 4 to/from the crankshaft 5 is placed in the generator chamber 8. This follows that the components 3, 4, 6 having relatively large weight are located on the rear end side of the engine 1, and the center of gravity of the engine 1 is thereby located at the rear portion of the engine 1. This is advantageous when the four-cycle engine is mounted in the personal watercraft.

The crankshaft 5 of this embodiment is comprised of the crankshaft body 5A and the first extended shaft member 15, which are connected to each other to be rotatable integrally with and separable from each other. This advantageously reduces the length of the crankshaft body 5A of a complex shape so as to be easily manufactured. In addition, since the rotator 12 of the generator 3 is formed integrally with the first extended shaft member 15 having the output shaft end, the generator 3 is easily placed at the rear end portion of the crankshaft, and assembly is facilitated.

Figure 2:
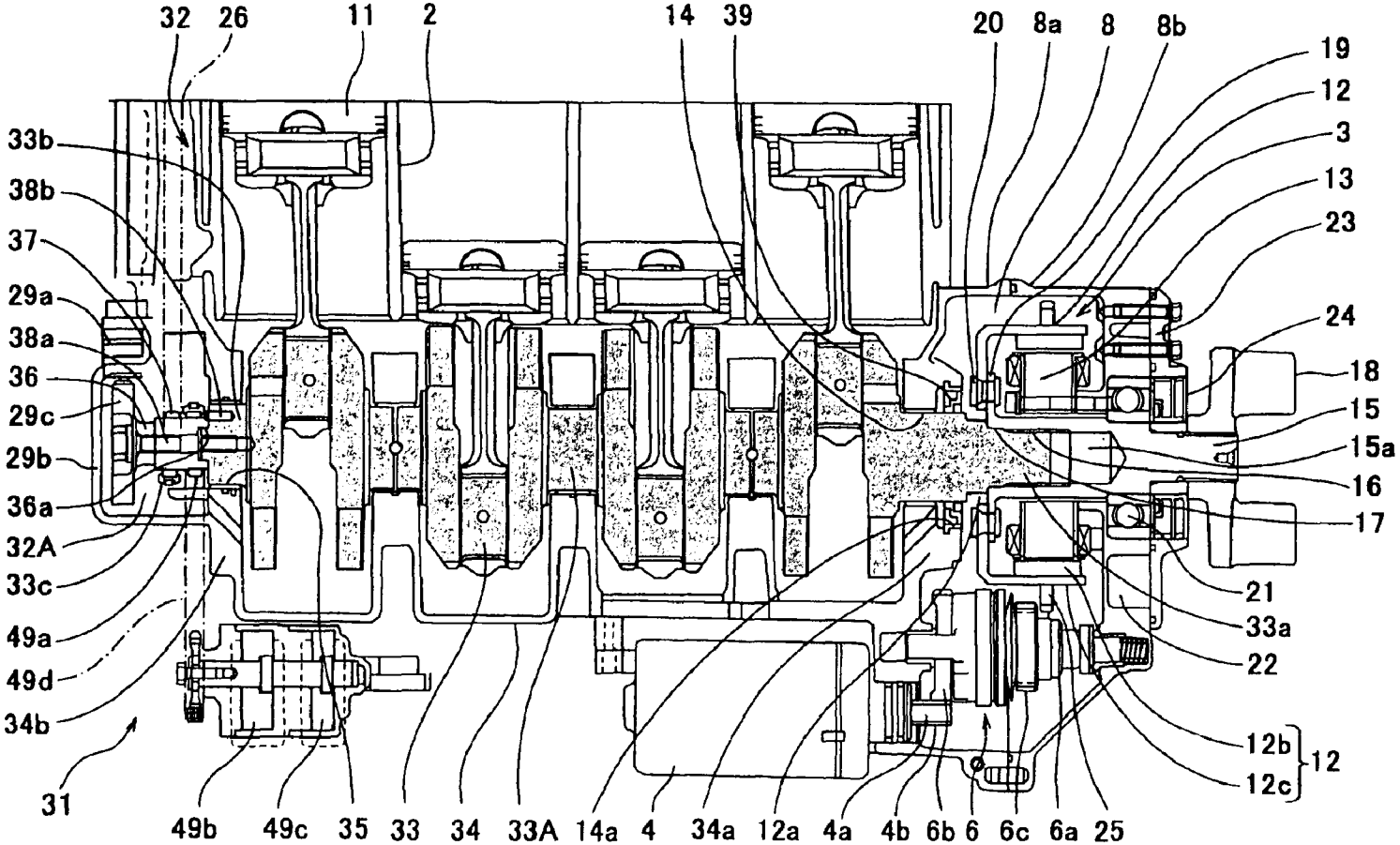
FIG. 2 is a longitudinal sectional view showing a portion including a crankshaft of an engine for a personal watercraft according to another embodiment of the present invention.

FIG. 2 shows an engine 31 according to another embodiment. The engine 31 is identical in structure to the engine 1 in FIG. 1 except that a cam chain tunnel 32 is provided on the front end side of the engine 31. Therefore, the same components as those in the engine 1 in FIG. 1 are identified by the same reference numerals and will not be further described.

A front end portion 33*b* of a crankshaft body 33A of a crankshaft 33 of the engine 31 is rotatably supported by a penetrating hole 35 formed in a front end wall 34*b* of a crankcase 34. A second extended shaft member 36 is located in a front chamber 32A that defines a cam chain tunnel 32 formed in a front portion of the front end wall 34*b* and is connected to a tip end of the front end portion 33*b* in such a manner that the second extended shaft member 36 is rotatable integrally with and separable from a crankshaft body 33A. A sprocket 37 for cam chain is mounted to the second extended shaft member 36. A front end face of the crankshaft body 33A is substantially coplanar with an outer face of the front end wall 34*b* of the crankcase 34. A convex portion 33*c* for fitting is formed in the front end face of the crankshaft body 33A. A fitting hole 36*a* fitted over the convex portion 33C, is formed in a rear end face of the second extended shaft member 36. The convex portion 33*c* and the fitting hole 36*a* constitute so-called centering-location portion, where an outer peripheral face of the convex portion 33*c* is fitted to the corresponding inner peripheral face of the fitting hole 36*a* without substantial clearance. The fitting face is formed concentrically with a rotational center axis of the crankshaft 33.

The second extended shaft member 36 is fitted to the front end of the crankshaft body 33A and secured thereto by means of a bolt 38*a*. To prevent the second extended shaft 36 from rotating relatively to the crankshaft body 33A, a pin 38*b* for preventing rotation is attached to the front end face of the crankshaft body 33A.

A sprocket-mounting portion for mounting the cam sprocket 27 in FIG. 1 is not provided at a rear end portion 33*a* of the crankshaft body 33A, but instead, the first extended shaft member 15 is exteriorly fitted to a portion of the crankshaft body 33A outside a penetrating hole 14 of a crankcase 34. The rotor 12 is mounted to the first extended shaft member 15 as in the crankshaft 5 in FIG. 1. For sealing between the generator chamber 8 and an inner portion 34*b* of the crankcase 34, a seal member 39 is attached to the penetrating hole 14 in the rear end wall 34*a* of the crankcase 34. The sealing prevents an oil in the inner portion 34*b* of the crankcase 34 from flowing into the inside of the generator chamber 8. As a result, loss of rotational energy of the generator 8 which would be caused by viscosity of the oil is avoided.

As should be appreciated, since the sprocket-mounting portion is not provided on the rear end portion 33*a* of the crankshaft body 33A, the crankshaft 33 is shorter than the crankshaft 5 of the engine 1 in FIG. 1 substantially by difference between the length of the sprocket-mounting portion and the length of the seal member 39.

Reference numeral 49*a* denotes a sprocket for driving a scavenging pump 49*b* or a feed pump 49*c* by means of a chain 49*d*.

Figure 3:
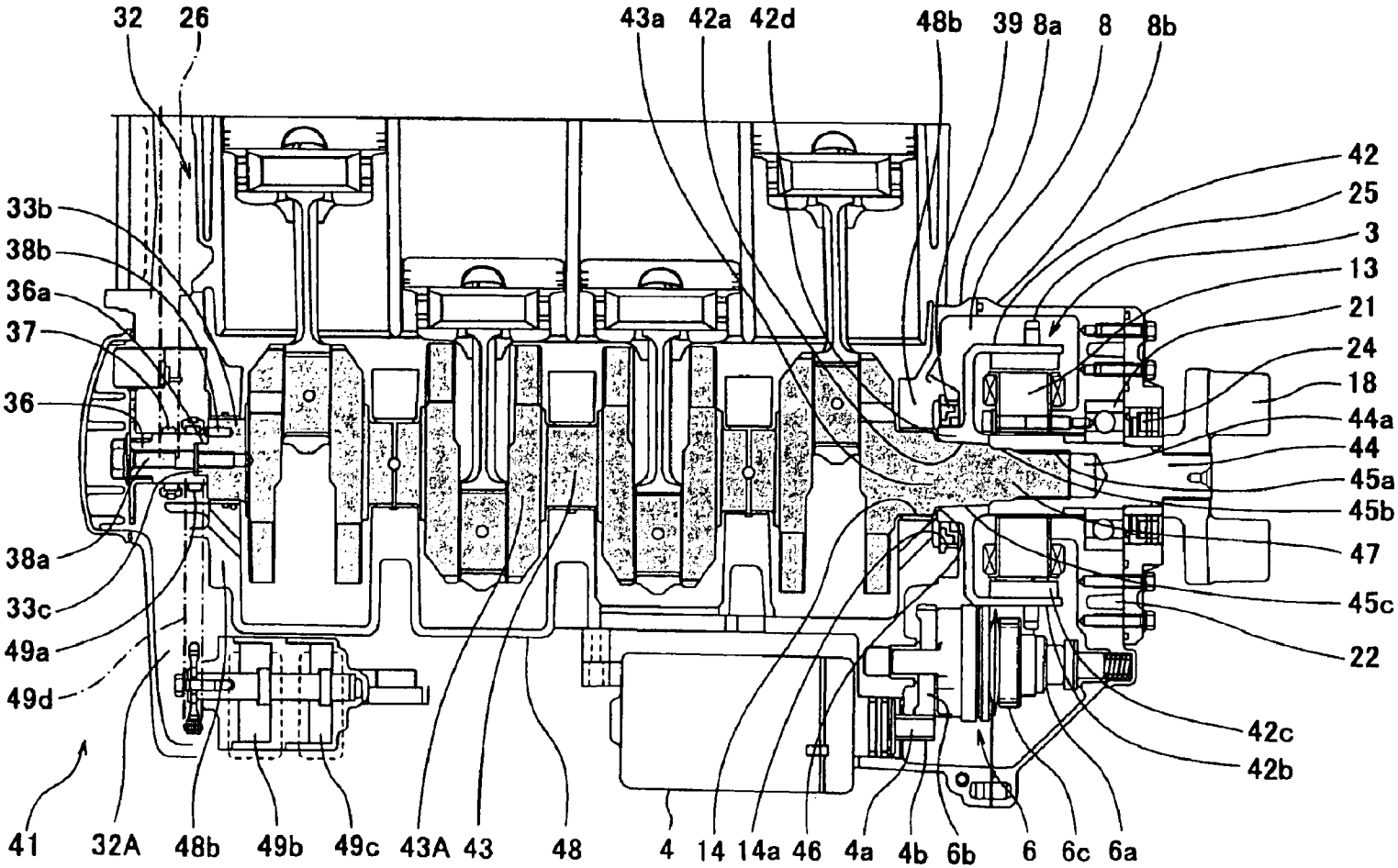
FIG. 3 is a longitudinal sectional view showing a portion including a crankshaft of an engine for a personal watercraft according to another embodiment of the present invention.

FIG. 3 shows an engine 41 according to another embodiment. The engine 41 is identical in structure to the engine 31 in FIG. 2 except for a mounting mechanism of a rotor 42. Therefore, the same components as those in FIG. 2 are identified by the same reference numerals and will not be further described.

As shown in FIG. 3, a screw portion 45*a* for connecting a first extended shaft member 44 and a centering-location portion 45*b* for causing a rotational center axis of the first extended shaft member 44 to conform to a rotational center axis of a crankshaft body 43A are formed in a rear end portion 43*a* of the crankshaft body 43A. The first extended shaft member 44 is provided with a connecting hole 44*a* for connecting the crankshaft body 43A. The connecting hole 44*a* has an inner thread and a fitting portion inside thereof.

A small-diameter portion 47 is formed with a step portion 46 at the rear end portion 43*a* of the crankshaft body 43A. The screw portion 45*a* and the centering location portion 45*b* are formed in the small-diameter portion 47. A portion 45*c* of the small-diameter portion 47 between the centering location portion 45*b* and the step portion 46 is tapered with a diameter increasing toward the step portion 46. The portion 45*c* is also expressed as a taper portion 45*c*. A rotor 42 of the generator 3 is cylindrical with a bottom. A cylindrical boss 42*d* having an inner peripheral face 42*a* to which the taper portion 45*c* is fitted is formed at a bottom portion of the rotor 42. The inner peripheral face 42*a* is tapered to allow fitting to the taper portion 45*c*. The rotor 42 is first fitted to the taper portion 45*c*, and the first extended shaft member 44 is screwed to the screw portion 45*a* of the small-diameter portion 47, thereby causing the rotor 42 to be pressed toward the large-diameter side of the taper portion 45*c*. As a result, the inner peripheral face 42*a* of the cylindrical boss 42*d* is fitted to the taper portion 45*c*, and thus, the rotor 42 is fixed to the taper portion 45*c* of the crankshaft body 43A. A magnet 42*c* is fixed to an inner peripheral face of a cylindrical body portion 42*b* like the rotor 12 in FIGS. 1 and 2.

A seal member mounting portion 14*a* is formed in a rear portion of the penetrating hole 14 formed in the rear end portion 48*b* of the crankcase 48. Between an inner peripheral face of the seal member mounting portion 14*a* and an outer peripheral face of the cylindrical portion 42*d* of the rotor 42, a seal member 39 is provided for sealing between an inside of the crankcase 48 and the generator 8.

The crankshaft 43 is shorter than the crankshaft 33 of the engine 31 in FIG. 2 substantially by difference between the length of the rivet 20 (FIG. 2) and the thickness of the flange 19 (FIG. 2). Also, since the rotor 42 is independent of the first extended shaft member 44, the first extended shaft member 54 is simply shaped.

Figure 4:
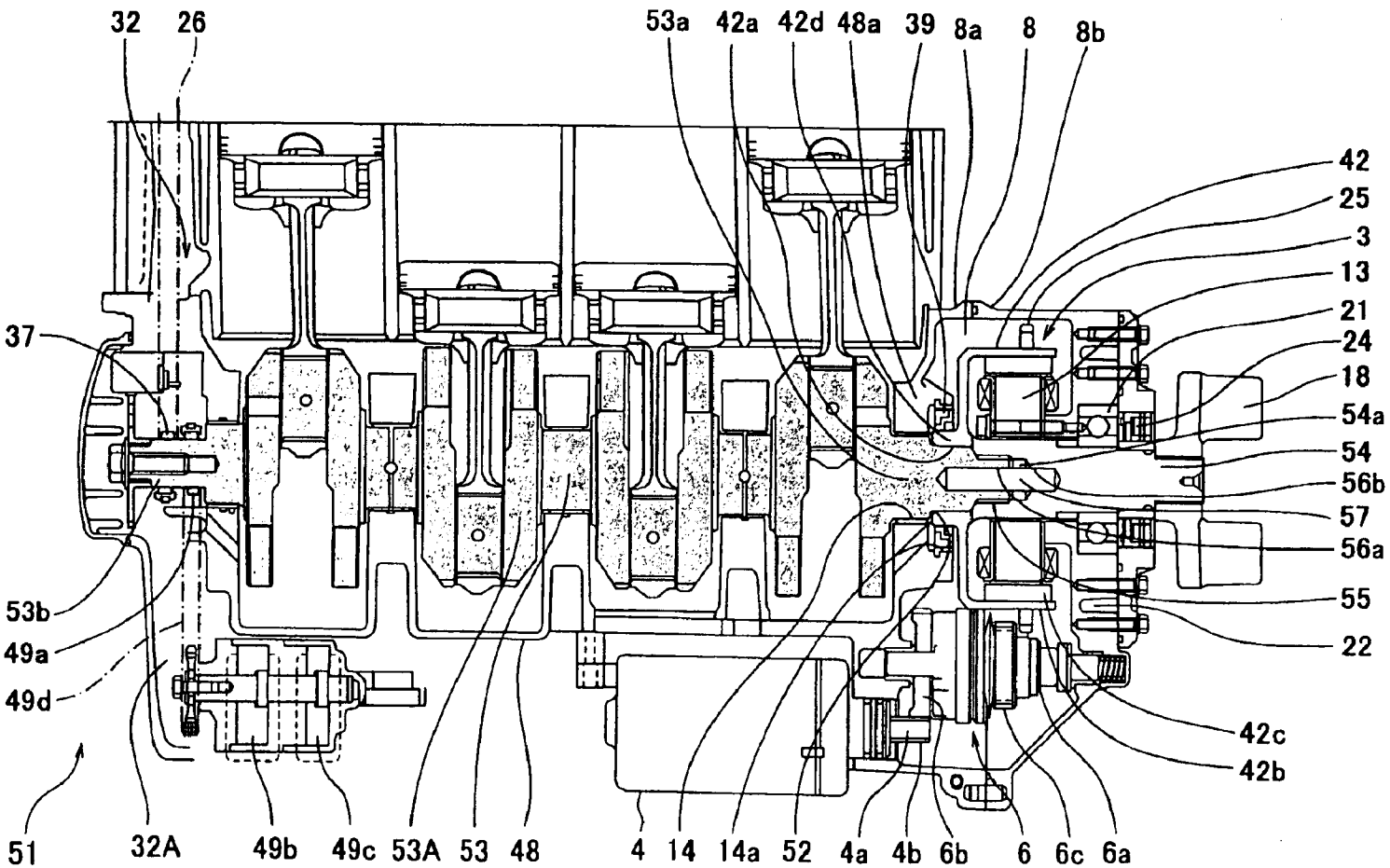
FIG. 4 is a longitudinal sectional view showing a portion including a crankshaft of an engine for a personal watercraft according to another embodiment of the present invention.
Figure 5:
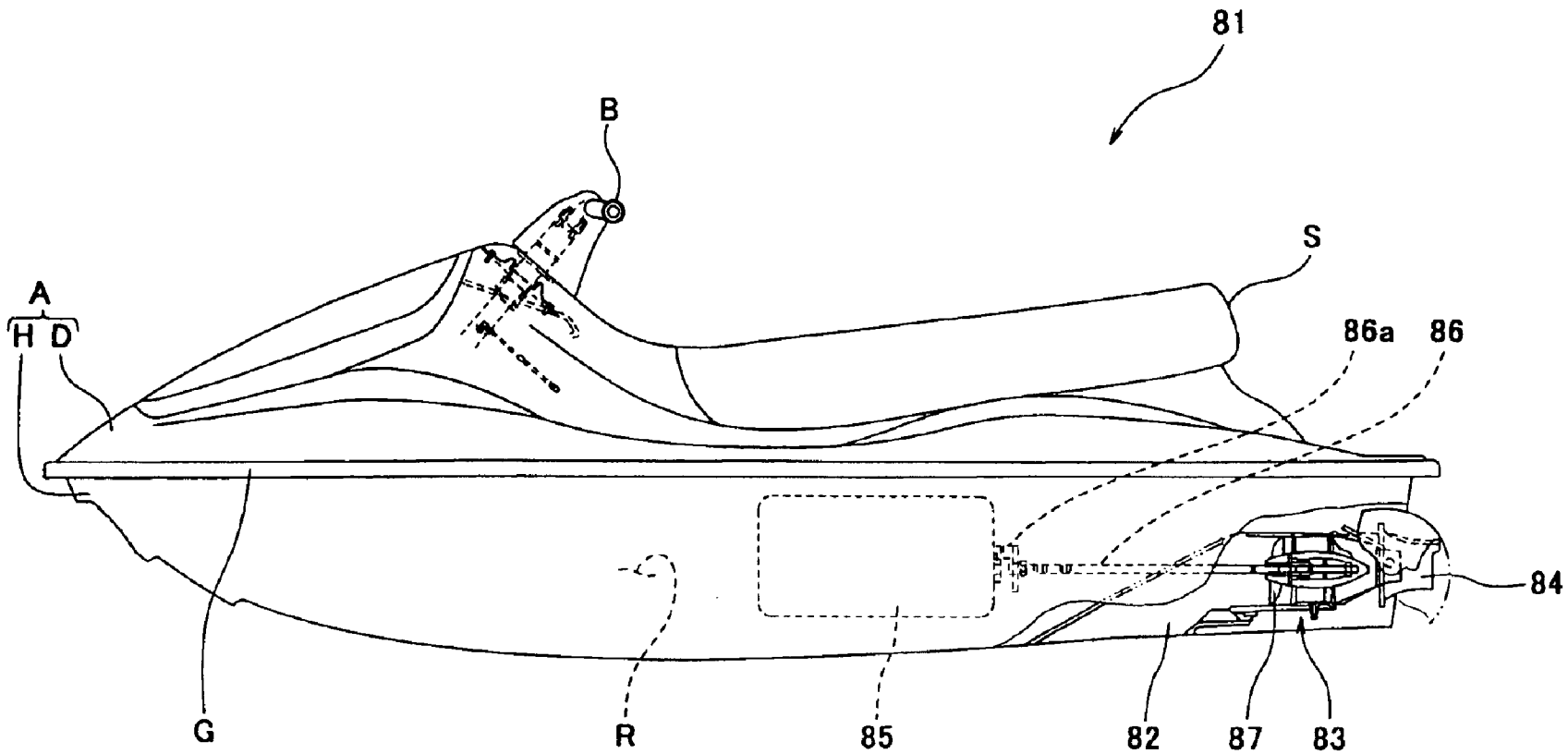
FIG. 5 is a partially cross-sectional side view showing an example of a personal watercraft capable of mounting the engine of the present invention or the conventional engine.

FIG. 4 shows an engine 51 according to another embodiment. The same components as those in the engine 41 in FIG. 3 are identified by the same reference numerals and will not be further described. In the engine 51, the rotor 42 is fixed to a crankshaft body 53A by mounting a first extended shaft member 54 to a crankshaft body 53A in such a manner that a rear end portion 53*a* of the crankshaft body 53A is inserted into a connecting hole 54*a* of the first extended shaft member 54. The engine 51 does not have the second extended shaft member 36(FIG. 3) unlike the engine 41 in FIG. 3. In addition, the centering location portion is not formed in the portion where the rear end portion 53*a* of the crankshaft body 53A is fitted to the first extended shaft member 54.

The rear end portion 53*a* is connected to the first extended shaft member 54 by means of a screw portion 55. A fitting hole 56*a* is formed on a rear end face of the crankshaft body 53A and a fitting hole 56*b* is formed on the bottom of a connecting hole 54*a* provided on a front end of the first extended shaft member 54. A shaft 57 for allowing a center axis of the crankshaft body 53A to conform to the center axis of the first extended shaft member 54 penetrates into the fitting holes 56*a*, 56*b*. The fitting hole 56*a* is concentric with the crankshaft body 53A and the fitting hole 56*b* is concentric with the center axis of the first extended shaft member 54. Specifically, a centering-location portion for centering the first extended shaft member 54 and the crankshaft body 53A is formed between an outer peripheral face of the shaft 57 and inner peripheral faces of the fitting holes 56*a*, 56*b*. By fittingly inserting the shaft 57 into the fitting holes 56*a*, 56*b*, the crankshaft body 53A is caused to be coaxial with the first extended shaft member 54.

With the above-mentioned structure, the crankshaft body 53A is shorter than the crankshaft body 43A in FIG. 3 substantially by the length of the centering-location portion in the rear end portion 43*a*.

Although the present invention has been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An engine of a personal watercraft, comprising:

a crankcase having a front end wall and a rear end wall;

a crankshaft provided inside the crankcase;

a generator chamber formed in a rear portion of the rear end wall of the crankcase;

a generator provided in the generator chamber, the generator being positioned at an output end portion of the crankshaft on a rear side of the engine, the generator including a rotor mounted to a portion of the output end portion of the crankshaft;

a coupling configured to be coupled to a propeller shaft of the watercraft, wherein the coupling is coaxially mounted outside the generator chamber and on a rear side of the rotor;

a starter motor provided on an output end side of the crankshaft outside the crankcase;

a clutch provided between the starter motor and the rotor of the generator, for connecting and disconnecting the starter motor to and from the rotor;

a cam chain tunnel formed on an opposite side of the output end side of the crankshaft;

a cam chain sprocket mounted to an end portion of the crankshaft on the opposite side of the output end side, the crankshaft passing through a penetrating hole formed in the front end wall of the crankcase and protruding into the cam chain tunnel; and wherein the crankshaft passes through a penetrating hole formed in the rear end wall of the crankcase and the output end portion of the crankshaft protrudes into the generator chamber; and wherein the output end portion of the crankshaft is configured to transmit a propulsion force for propelling the watercraft; and wherein a seal member is provided in the penetrating hole of the crankcase to seal between an inside of the crankcase and the generator chamber.

2. The engine of a personal watercraft according to claim 1, further comprising a water jacket formed in a housing constituting the generator chamber to allow cooling water to flow therethrough.

3. An engine of a personal watercraft, comprising:

a crankcase having a front end wall and a rear end wall;

a crankshaft provided inside the crankcase;

a generator provided at an output end portion of the crankshaft, the generator including a rotor;

a starter motor provided on an output end side of the crankshaft outside the crankcase;

a clutch provided between the starter motor and the rotor of the generator, for connecting and disconnecting the starter motor to and from the rotor;

a generator chamber formed in a rear portion of the rear end wall of the crankcase, for containing the generator;

a cam chain tunnel communicating with an inside of the generator chamber;

wherein the rotor is mounted to the output end portion of the crankshaft passing through a penetrating hole formed in the rear end wall of the crankcase and protruding into the generator chamber;

a cam chain sprocket mounted to a portion of the crankshaft between the rotor and the penetrating hole;

wherein a water jacket is formed in a housing constituting the generator chamber to allow cooling water to flow therethrough.

4. An engine of a personal watercraft comprising:

a crankcase having a front end wall and a rear end wall;

a generator chamber formed in a rear portion of the rear end wall of the crankcase, for containing a generator;

a crankshaft provided inside the crankcase, the crankshaft including a crankshaft body having one end portion passing through the rear end wall of the crankcase and protruding into the generator chamber, and a first extended shaft member contained inside the generator chamber and having one end portion connected to the one end portion of the crankshaft body so as to be rotatable integrally with and separable from the crankshaft body and an opposite end portion protruding from the generator chamber outward relative to the generator chamber; and a rotor-mounting portion formed integrally with the first extended shaft member, for mounting a rotor of the generator;

wherein the first extended shaft member constitutes an output end part of the engine.

5. An engine of a personal watercraft, comprising:

a crankcase having a front end wall and a rear end wall; a generator chamber formed in a rear portion of the rear end wall of the crankcase, for containing a generator, a crankshaft provided inside the crankcase, the crankshaft including a crankshaft body having one end portion passing through the rear end wall of the crankcase and protruding into the generator chamber, and a first extended shaft member contained inside the generator chamber and having one end portion connected to the one end portion of the crankshaft body so as to be rotatable integrally with and separable from the crankshaft body and an opposite end portion protruding from the generator chamber outward relative to the generator chamber; and a rotor-mounting portion provided at the one end portion of the crankshaft body protruding into the generator chamber, for mounting a rotor of the generator, the rotor of the generator being fixed to the rotor-mounting portion by mounting the first extended shaft member to the one end portion of the crankshaft body;

wherein the first extended shaft member constitutes an output end part of the engine.

6. The crankshaft of an engine for a personal watercraft according to claim 4, further comprising a second extended shaft member connected to the other end portion of the crankshaft body to be rotatable integrally with and separable from the crankshaft body; and a sprocket-mounting portion for mounting a cam-driving sprocket on the second extended shaft member.

7. The crankshaft of an engine for a personal watercraft according to claim 4, further comprising:

a sprocket-mounting portion formed at the one end portion of the crankshaft body adjacent the first extended shaft member, for mounting a cam-driving sprocket of the engine.

8. The crankshaft of an engine for a personal watercraft according to claim 4, wherein a connecting hole is formed in an end portion of the first extended shaft member for connecting the crankshaft body by inserting the one end portion of the crankshaft body thereinto, an outer peripheral face of the one end portion of the crankshaft body and an inner peripheral face of the connecting hole of the first extended shaft member respectively have a cylindrical fitting face for centering and an engagement portion for preventing circumferential relative rotation between the crankshaft body and the first extended shaft member, and a center axis of the fitting face of the crankshaft body corresponds with a rotational center axis of the crankshaft and a center axis of the fitting face of the first extended shaft member corresponds with a center axis of the first extended shaft member.

9. The crankshaft of an engine for a personal watercraft according to claim 5, further comprising a second extended shaft member connected to the other end portion of the crankshaft body to be rotatable integrally with and separable from the crankshaft body; and a sprocket-mounting portion for mounting a cam-driving sprocket on the second extended shaft member.

10. The crankshaft of an engine for a personal watercraft according to claim 5, wherein a connecting hole is formed in an end portion of the first extended shaft member for connecting the crankshaft body by inserting the one end portion of the crankshaft body thereinto, an outer peripheral face of the one end portion of the crankshaft body and an inner peripheral face of the connecting hole of the first extended shaft member respectively have a cylindrical fitting face for centering and an engagement portion for preventing circumferential relative rotation between the crankshaft body and the first extended shaft member, and a center axis of the fitting face of the crankshaft body corresponds with a rotational center axis of the crankshaft and a center axis of the fitting face of the first extended shaft member corresponds with a center axis of the first extended shaft member.

* * * * *